US010269316B2

(12) United States Patent
Sakurai

(10) Patent No.: US 10,269,316 B2
(45) Date of Patent: Apr. 23, 2019

(54) METHOD FOR DRIVING A DISPLAY DEVICE INCLUDING FLICKER CHECK CIRCUITRY

(71) Applicant: Sharp Kabushiki Kaisha, Sakai, Osaka (JP)

(72) Inventor: Takehisa Sakurai, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 186 days.

(21) Appl. No.: 15/500,985

(22) PCT Filed: Aug. 20, 2015

(86) PCT No.: PCT/JP2015/073318
§ 371 (c)(1),
(2) Date: May 19, 2017

(87) PCT Pub. No.: WO2016/031659
PCT Pub. Date: Mar. 3, 2016

(65) Prior Publication Data

US 2018/0040285 A1 Feb. 8, 2018

(30) Foreign Application Priority Data

Aug. 26, 2014 (JP) ..... 2014-171981

(51) Int. Cl.
*G09G 3/36* (2006.01)
*G09G 3/34* (2006.01)

(52) U.S. Cl.
CPC ..... *G09G 3/3614* (2013.01); *G09G 3/3618* (2013.01); *G09G 3/3648* (2013.01);
(Continued)

(58) Field of Classification Search
CPC .. G09G 3/3614; G09G 3/3655; G09G 3/3618; G09G 3/3677; G09G 3/3648;
(Continued)

(56) References Cited

U.S. PATENT DOCUMENTS

2002/0041281 A1 4/2002 Yanagi et al.
2002/0080127 A1* 6/2002 Park ..... G09G 3/3406 345/204
(Continued)

FOREIGN PATENT DOCUMENTS

JP 2002-116739 A 4/2002
JP 2003-066920 A 3/2003
(Continued)

OTHER PUBLICATIONS

Official Communication issued in International Patent Application No. PCT/JP2015/073318, dated Nov. 24, 2015.
(Continued)

*Primary Examiner* — Rodney Amadiz
(74) *Attorney, Agent, or Firm* — Keating & Bennett, LLP

(57) ABSTRACT

Provided is a display device capable of satisfactorily reducing power consumption while suppressing display degradation due to flicker. When an input unit (70) of a host accepts a predetermined input operation performed by a user (4) during pause driving of a liquid crystal display device (2), a check and adjustment process is started. In this check and adjustment process, a counter voltage that is applied to a common electrode of a display unit (100) changes from an optimum value (a value corresponding to a positive-negative balanced state) in accordance with the input operation performed by the user (4). When the user (4) performs an "OK" operation upon starting to perceive flicker during this course of change in the counter voltage, a flicker check unit (222) calculates flicker sensitivity from an amount of change
(Continued)

ΔVcom in counter voltage at that time, and a driving adjustment unit (224) adjusts a refresh rate and display brightness in the display unit (100) based on this flicker sensitivity via a driving control unit (210) and the like.

3 Claims, 7 Drawing Sheets

(52) U.S. Cl.
CPC ..... *G09G 3/3655* (2013.01); *G09G 3/3677* (2013.01); *G09G 3/3406* (2013.01); *G09G 3/3688* (2013.01); *G09G 2320/0247* (2013.01); *G09G 2320/066* (2013.01); *G09G 2320/0626* (2013.01); *G09G 2330/021* (2013.01); *G09G 2330/022* (2013.01); *G09G 2330/12* (2013.01); *G09G 2340/0435* (2013.01); *G09G 2354/00* (2013.01); *G09G 2370/08* (2013.01)

(58) Field of Classification Search
CPC ..... G09G 2370/08; G09G 2340/0435; G09G 3/3406; G09G 2330/022; G09G 2320/0247; G09G 2354/00; G09G 2330/12; G09G 2320/0626; G09G 2320/066; G09G 2330/021; G09G 3/3688
See application file for complete search history.

(56) References Cited

U.S. PATENT DOCUMENTS

| | | | | |
|---|---|---|---|---|
| 2004/0105596 | A1 | 6/2004 | Inoue | |
| 2008/0297538 | A1* | 12/2008 | Cho | G09G 3/3655 345/690 |
| 2011/0157261 | A1 | 6/2011 | Harada et al. | |
| 2012/0138922 | A1 | 6/2012 | Yamazaki et al. | |
| 2014/0125569 | A1 | 5/2014 | Nakata et al. | |

FOREIGN PATENT DOCUMENTS

| | | | |
|---|---|---|---|
| JP | 2004-180142 | A | 6/2004 |
| JP | 2008-134291 | A | 6/2008 |
| JP | 2010-088862 | A | 4/2010 |
| JP | 2010-197597 | A | 9/2010 |
| JP | 2012-134475 | A | 7/2012 |
| WO | 2013/008668 | A1 | 1/2013 |

OTHER PUBLICATIONS

De Valois et al., "Psychophysical Studies of Monkey Vision—III. Spatial Luminance Contrast Sensitivity Tests of Macaque and Human Observers", Vision Res., vol. 14, 1974, pp. 75-81.

* cited by examiner

FIG. 5A
FIG. 5B
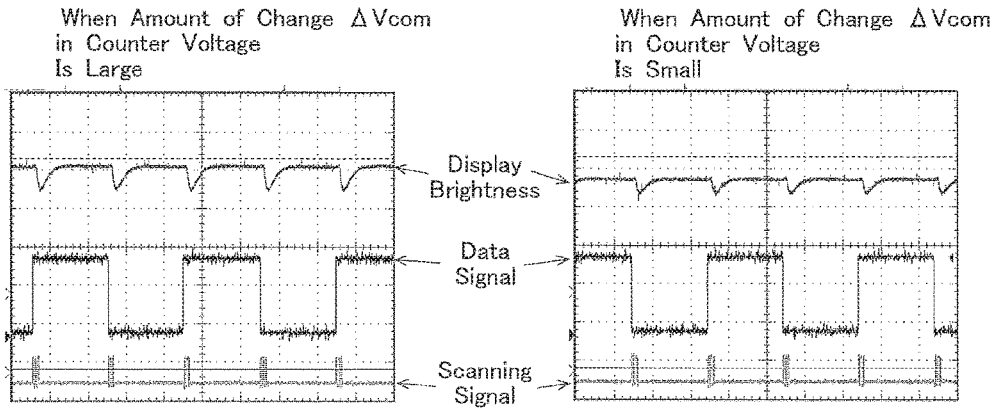
FIG. 6A
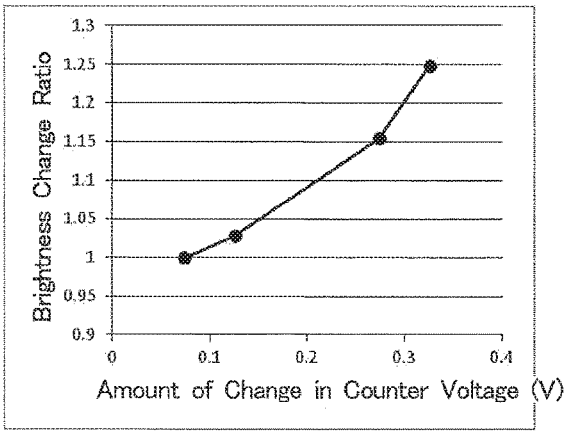
FIG. 6B
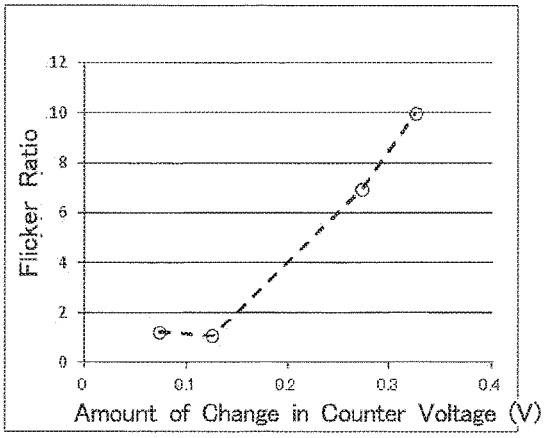

RF Period
NRF Period
NRF Period
RF Period

VSY

Sj
ΔVcom

Sj
(HiZ)
ΔVcom

Sj
(HiZ)

Sj
(HiZ)

METHOD FOR DRIVING A DISPLAY DEVICE INCLUDING FLICKER CHECK CIRCUITRY

TECHNICAL FIELD

The present invention relates to a display device of an alternating-current (AC) driving system, such as a liquid crystal display device, and more specifically relates to a display device capable of reducing power consumption while suppressing degradation in display quality due to flicker.

BACKGROUND ART

Display devices such as liquid crystal display devices have been used in portable electronic devices and have been required to reduce power consumption more than before. There has thus been proposed a method of driving a display device in which a scanning period (also referred to as a "refresh period") is set for scanning gate lines as scanning signal lines of the liquid crystal display device to perform refresh on a display image, and thereafter a pause period (also referred to as a "non-refresh period") is set for keeping all gate lines in a non-scanning state to pause the refresh (see, for example, Patent Document 1). In this pause period, for example, it is possible not to provide, for example, signals for control to a gate driver as a scanning signal line drive circuit and/or a source driver as a data signal line drive circuit. This can pause the operation of the gate driver and/or the source driver, to thereby reduce power consumption. Note that the driving performed by setting the pause period after the refresh period as thus described is called "pause driving" (or "low-frequency driving"), for example.

PRIOR ART DOCUMENTS

Patent Documents

[Patent Document 1] WO 2013/008668 A

[Patent Document 2] Japanese Patent Application Laid-Open No. 2002-116739

[Patent Document 3] Japanese Patent Application Laid-Open No. 2010-197597

[Patent Document 4] Japanese Patent Application Laid-Open No. 2010-88862

Non-Patent Document

[Non-patent Document 1] Russel L. De Valois, Herman Morgan, and D. Max Snodderly, "Psychological Studies of Monkey Vision-III. Spatial Luminance Contrast Sensitivity Tests of Macaque and Human Observers", Vision Res. Vol. 14, pp. 75-81, Pergamon Press 1974

SUMMARY OF THE INVENTION

Problems to be Solved by the Invention

As described above, in the display device that performs the pause driving, a refresh rate is decreased to reduce power consumption. However, when the pause driving is performed, the user more easily sees flicker due to high contrast. Therefore, it is difficult to satisfactorily decrease a driving frequency and it is necessary to lower display brightness.

Meanwhile, in order to suppress display degradation by adjusting the driving frequency and the display brightness in accordance with the easiness to perceive flicker, there has been proposed a display device having a configuration for measurement of the (user's) contrast sensitivity or the like which indicates the easiness to perceive flicker (the measurement is hereinafter referred to as "flicker check") (see, for example, Patent Document 3 (Japanese Patent Application Laid-Open No. 2010-197597)). In this flicker check, a specific test image is displayed on the display device, to obtain evaluation information of the contrast sensitivity and the like in accordance with whether or not the user as an observer perceives flicker in the display image. At this time, the contrast sensitivity and the like are obtained while the driving frequency and the display brightness of the display device are switched to several levels. When such flicker check is to be conducted in the display device that performs the pause driving, the following problem may occur.

In this flicker check, the display device needs to be driven such that a specific test image is displayed in a specific form. The flicker check cannot be conducted on the display device which is driven at much a lower refresh rate than a normal refresh rate (e.g., 60 Hz) as is the pause driving. To deal with this, it may be considered that the driving frequency is increased and a specific indication is provided during the flicker check, but such a technique would lead to a large cost increase. Hence the liquid crystal display device and the like which perform the pause driving have not been able to satisfactorily reduce the driving frequency or increase the display brightness while suppressing the display degradation due to flicker, and have had difficulties in satisfactorily reducing power consumption while keeping favorable display quality.

Accordingly, an object of the present invention is to provide a display device capable of satisfactorily reducing power consumption while suppressing display degradation due to flicker.

Means for Solving the Problems

A first aspect of the present invention provides a display device for displaying an image by reversing polarity of a voltage at predetermined intervals and applying the voltage between each of a plurality of pixel electrodes and a common electrode that is provided so as to face the plurality of pixel electrodes in a display unit, the display device including:

a pixel electrode driving unit configured to provide a voltage to each of the plurality of pixel electrodes;

a common electrode driving unit configured to provide a voltage to the common electrode; and a display control unit configured to control the pixel electrode driving unit and the common electrode driving unit, wherein the display control unit includes

- a driving control unit configured to cause the pixel electrode driving unit to provide a plurality of pixel voltages in accordance with an inputted image signal respectively to the plurality of pixel electrodes and configured to cause the common electrode driving unit to provide a predetermined counter voltage to the common electrode, so as to display an image indicated by the image signal on the display unit,
- a flicker check unit configured to cause the common electrode driving unit to change the counter voltage from a state where positive and negative effective voltages which are applied between each of the pixel electrodes and the common electrode are balanced, and configured to obtain an index indicating easiness to perceive flicker of a display image on the display unit, based on an input operation in accordance with perception of flicker by an observer of the display unit, and a driving adjustment unit configured to bring the counter voltage back into the state where the positive and negative effective voltages are balanced when the flicker check unit obtains the index, and configured to adjust either or both of a refresh cycle and brightness of the display image in increasing directions in accordance with the obtained index.

A second aspect of the present invention provides the display device according to the first aspect of the present invention, in which a low-frequency driving mode is provided as a driving mode of the display unit, when the driving mode is the low-frequency driving mode, the driving control unit controls the pixel electrode driving unit and the common electrode driving unit such that a refresh period for refreshing the display image on the display unit based on the image signal and a non-refresh period for pausing refresh of the display image alternately appear, and when the driving mode is the low-frequency driving mode, the flicker check unit obtains the index.

A third aspect of the present invention provides the display device according to the first or second aspect of the present invention, in which when the flicker check unit obtains the index, the driving control unit controls the pixel electrode driving unit and the common electrode driving unit such that a predetermined checking image is displayed on the display unit instead of the image indicated by the image signal, the checking image being an image where the brightness changes so as to increase a spatial frequency in a first direction on a screen of the display unit and the brightness changes so as to decrease contrast in a second direction on the screen.

A fourth aspect of the present invention provides the display device according to any one of the first to third aspects of the present invention, in which the driving control unit controls the common electrode driving unit so as to provide the common electrode with a voltage as the counter voltage, a level of the voltage is switched between a predetermined high level and a predetermined low level in conjunction with the polarity reversal at predetermined intervals.

The other aspects of the present invention are obvious from the first to fourth aspects of the present invention and descriptions to be provided later regarding embodiments, and descriptions of those aspects are thus omitted.

Effects of the Invention

According to the first aspect of the present invention, under control of the flicker check unit, the common electrode driving unit changes the counter voltage from a state where positive and negative effective voltages that are applied between each of the pixel electrodes and the common electrode are balanced, and the flicker check unit obtains an index indicating the easiness to perceive flicker of a display image on the display unit, based on an input operation performed by the observer of the display unit in accordance with perception of flicker. When the flicker check unit obtains the index, the driving adjustment unit brings the counter voltage, provided to the common electrode, back into the state where the positive and negative effective voltages are balanced, and adjusts either or both of a refresh cycle and brightness of the display image in increasing directions in accordance with the obtained index. Accordingly, in a range where the observer does not perceive flicker in the display image, the image can be displayed in a long refresh cycle (at a low refresh rate) and/or with high display brightness. As a result, when the refresh cycle becomes long, power consumption can be reduced more than before because of a decrease in driving frequency. Moreover, when the display brightness becomes high, a favorable display image can be provided to the observer, and the fatigue of the observer can be reduced because of improvement in visibility.

According to the second aspect of the present invention, in the low-frequency driving mode, when the flicker check unit obtains the index indicating the easiness to perceive flicker in the display image, similarly to the above first aspect, the driving adjustment unit brings the counter voltage, provided to the common electrode, back into the state where the positive and negative effective voltages are balanced, and adjusts either or both of the refresh cycle and the brightness of the display image in increasing directions in accordance with the obtained index. Accordingly, when the display unit is being driven in the low-frequency driving mode, a similar effect to that of the above first aspect can be obtained. Further, since the index indicating the easiness to perceive flicker of the display image can be obtained in a state close to a normal use environment (during the pause driving), the burden of the observer and cost for obtaining the index can be kept low.

According to the third aspect of the present invention, when the flicker check unit obtains the index indicating the easiness to perceive flicker of the display image, a predetermined checking image is displayed on the display unit, the image being an image where the brightness changes so as to increase a spatial frequency in a first direction on the screen of the display unit and the brightness changes so as to decrease contrast in a second direction on the screen. During the display of such a checking image, when the counter voltage changes from the state where the positive and negative effective voltages that are applied between each of the pixel electrodes and the common electrode are balanced, flicker can be more reliably perceived by the observer of the display unit, to obtain the index indicating the easiness to perceive flicker. Thus, in accordance with the obtained index, the refresh cycle and/or the brightness of the display image can be reliably adjusted in a short time.

According to the fourth aspect of the present invention, the level of the counter voltage provided to the common electrode is switched in conjunction with the polarity reversal of the voltage applied between the pixel electrode and the common electrode (so-called "counter AC driving" is performed), thereby significantly reducing an amplitude of the voltage provided to each of the pixel electrodes. Hence it is possible to reduce power consumption of the pixel electrode driving unit. Further, such counter AC driving decreases a difference between the positive voltage and the negative voltage which are provided to each of the pixel electrodes, and it is thus possible to prevent a decrease in contrast of the display image caused by a voltage drop due to resistance and capacitance which are parasitic in the pixel electrode driving unit and the like.

Effects of the other aspects of the present invention are obvious from the effects of the first to fourth aspects of the present invention described above and embodiments described below, and descriptions of those effects are thus omitted.

BRIEF DESCRIPTION OF THE DRAWINGS

FIGS. 5(A) and 5(B) are signal waveform diagrams for describing measurement to confirm an action of the first embodiment.

FIGS. 6(A) and 6(B) are diagrams showing results of the measurement to confirm the action of the first embodiment.

MODES FOR CARRYING OUT THE INVENTION

Each embodiment of the present invention will be described below. It is assumed below that one frame period is a period for refresh for one screen (rewriting of a display image), and a length of the "one frame period" is a length (16.67 ms) of one frame period in a typical display device with a refresh rate of 60 Hz, but the present invention is not limited thereto.

<1. First Embodiment>

<1.1 Entire Configuration and Outline of Operation>

Figure 1:
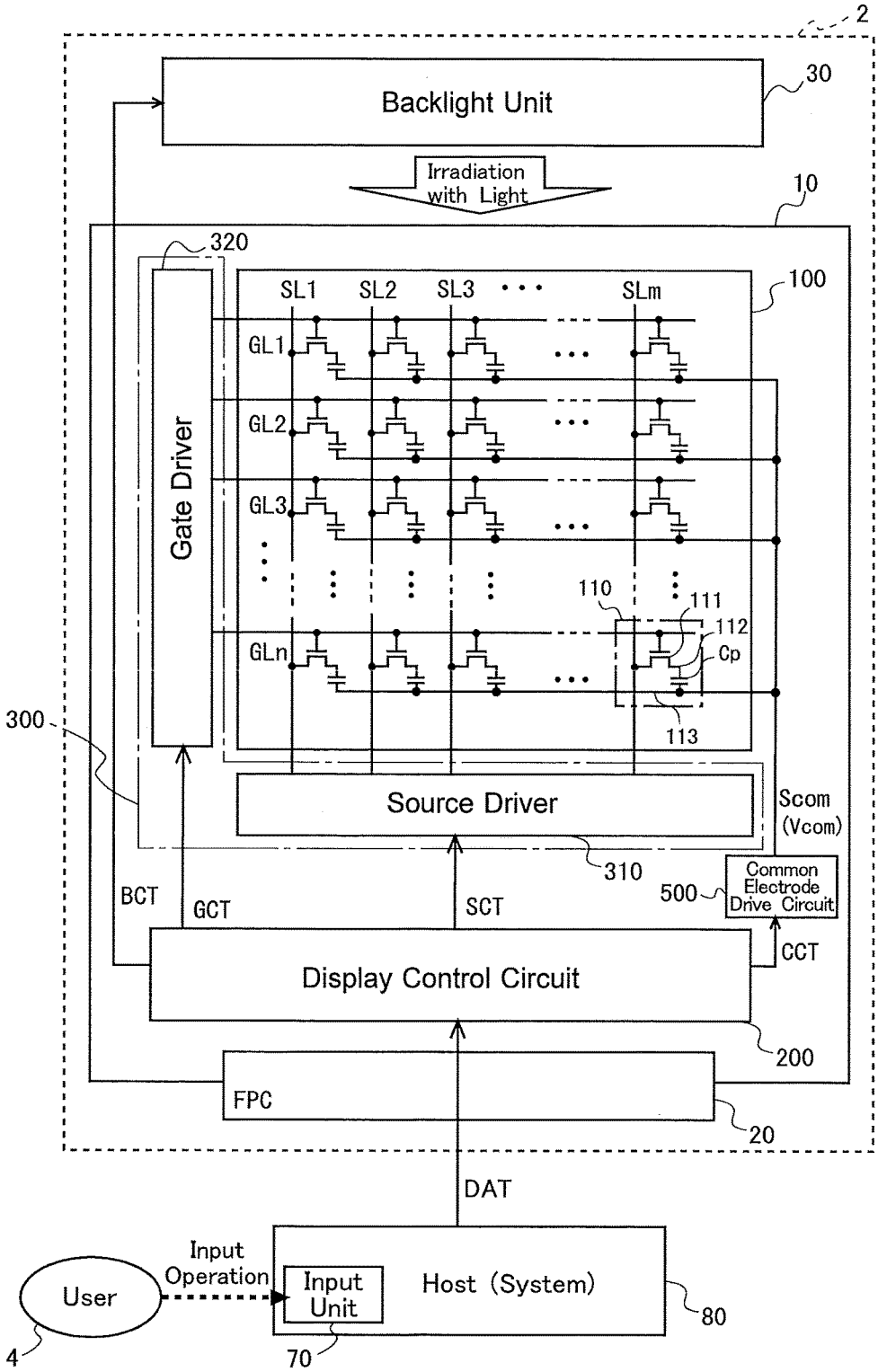
FIG. 1 is a block diagram showing a configuration of a liquid crystal display device according to a first embodiment of the present invention.

FIG. 1 is a block diagram showing a configuration of a liquid crystal display device according to a first embodiment of the present invention. This liquid crystal display device 2 includes a liquid crystal panel 10 and a backlight unit 30. The liquid crystal panel 10 is provided with an FPC (Flexible Printed Circuit) for external connection. Further, a display unit 100, a display control circuit 200, a source driver 310 as a data signal line drive circuit, a gate driver 320 as a scanning signal line drive circuit, and a common electrode drive circuit 500 are provided on the liquid crystal panel 10. Note that the source driver 310 and the gate driver 320 constitute a pixel electrode drive circuit 300 for providing a voltage to a pixel electrode described later, and either or both of the source driver 310 and the gate driver 320 may be provided in the display control circuit 200. Alternatively, either or both of the source driver 310 and the gate driver 320 may be formed integrally with the display unit 100. Outside the liquid crystal display device 2, a host 80 (a system) mainly made up of a CPU (Central Processing Unit) is provided. This host 80 includes an input unit 70 capable of accepting an input operation from a user 4 of the liquid crystal display device 2 according to the present embodiment or an electronic device including this liquid crystal display device 2 and the host 80. Note that the input unit capable of accepting an input operation from the user 4 may be provided in the liquid crystal display device 2 instead of being provided in the host 80.

In the display unit 100, the following are formed: a plurality of (m) source lines SL1 to SLm as data signal lines; a plurality of (n) gate lines GL1 to GLn as scanning signal lines; and a plurality of (m×n) pixel formation portions 110 provided corresponding to intersections of the m source lines SL1 to SLm and the n gate lines GL1 to GLn. Hereinafter, when the m source lines SL1 to SLm are not to be distinguished, they are simply referred to as "source lines SL", and when the n gate lines GL1 to GLn are not to be distinguished, they are simply referred to as "gate lines GL". The m×n pixel formation portions 110 are formed in a matrix form along the source line SL and the gate line GL. Each pixel formation portion 110 is made up of: a TFT (Thin Film Transistor) 111 as a switching element which has its gate terminal as a control terminal connected to the gate line GL passing through the corresponding intersection, and its source terminal connected to the source line SL passing through the intersection; a pixel electrode 112 connected to a drain terminal of the TFT 111; a common electrode 113 provided so as to be shared by the m×n pixel formation portions 110; and a liquid crystal layer sandwiched between the pixel electrode 112 and the common electrode 113 and provided so as to be shared by the plurality of pixel formation portions 110. A liquid crystal capacitance formed of the pixel electrode 112 and the common electrode 113 constitutes a pixel capacitance Cp. However, since an auxiliary capacitance is normally provided in parallel with the liquid crystal capacitance so as to reliably hold a voltage in the pixel capacitance Cp, the liquid crystal capacitance and the auxiliary capacitance practically constitute the pixel capacitance Cp.

In the present embodiment, as the TFT 111, for example, a TFT using an oxide semiconductor layer for a channel layer (hereinafter referred to as an "oxide TFT") is used. The oxide semiconductor layer contains In—Ga—Zn—O-based semiconductor, for example. The In—Ga—Zn—O-based semiconductor is a ternary oxide of In (indium), Ga (gallium), and Zn (zinc), and a ratio (a composition ratio) of In, Ga, and Zn is not particularly limited, with examples thereof including In:Ga:Zn=2:2:1, In:Ga:Zn=1:1:1, and In:Ga:Zn=1:1:2. In the present embodiment, an In—Ga—Zn—O-based semiconductor film containing In, Ga, and Zn at a ratio of 1:1:1 is used.

A TFT containing the In—Ga—Zn—O-based semiconductor layer has high mobility (more than twenty times that of a TFT using amorphous silicon for a channel layer, namely an a-SiTFT) and a low leakage current (less than one hundredth of that of the a-SiTFT), and hence the TFT can be preferably used as a driving TFT and a pixel TFT. The use of the TFT containing the In—Ga—Zn—O-based semiconductor layer enables significant reduction in power consumption of the display device.

The In—Ga—Zn—O-based semiconductor may be amorphous, or may contain a crystalline portion and have crystallinity. As the crystalline In—Ga—Zn—O-based semiconductor, a crystalline In—Ga—Zn—O-based semiconductor with a c-axis oriented almost vertical to the layer surface is preferred. Such a crystal structure of the In—Ga—Zn—O-based semiconductor is disclosed in Japanese Patent Application Laid-Open No. 2012-134475, for example. The entire contents disclosed in Japanese Patent Application Laid-Open No. 2012-134475 are incorporated herein by reference.

The oxide semiconductor layer may contain another oxide semiconductor layer instead of the In—Ga—Zn—O-based semiconductor. For example, the oxide semiconductor layer may contain Zn—O-based semiconductor (ZnO), In—Zn—

O-based semiconductor (IZO (registered trademark)), Zn—Ti—O-based semiconductor (ZTO), Cd—Ge—O-based semiconductor, Cd—Pb—O-based semiconductor, CdO (cadmium oxide), Mg—Zn—O-based semiconductor, In—Sn—Zn—O-based semiconductor (e.g., $In_2O_3$—$SnO_2$—ZnO), or In—Ga—Sn—O-based semiconductor. Note that the use of the oxide TFT as the TFT 111 is a mere example, and instead of this, a silicon-based TFT or the like may be used.

The display control circuit 200 receives data DAT for each screen from the host 80 via the FPC 20. This data DAT includes an image signal representing an image to be displayed, and the display control circuit 200 generates and outputs a signal line control signal SCT, a scanning line control signal GCT, and a common electrode control signal CCT, based on the data DAT. The signal line control signal SCT is provided to the source driver 310, the scanning line control signal GCT is provided to the gate driver 320, and the common electrode control signal CCT is provided to a common electrode drive circuit 500. The common electrode drive circuit 500 generates a common electrode signal Scom based on the common electrode control signal CCT, and provides it as a counter voltage Vcom to the common electrode 113. In the present embodiment, a predetermined fixed voltage is provided as the common electrode signal Scom to the common electrode 113. It may be configured such that the common electrode drive circuit 500 is included in the display control circuit 200, and the common electrode signal Scom is directly provided from the display control circuit 200 to the common electrode 113.

The data DAT is transmitted and received between the display control circuit 200 and the external host 80 via an interface proposed by MIPI (Mobile Industry Processor Interface) Alliance and compliant to the DSI (Display Serial Interface) standard. This interface compliant to the DSI standard enables high-speed data transmission. The transmission and reception of data between the display control circuit 200 in the liquid crystal display device and the host also apply to each embodiment described later. However, in the present invention, the interface used for transmitting and receiving data and a signal between the display device and the host is not limited to the interface compliant to the DSI standard, and instead of this or together with this, another appropriate interface may be used, such as an interface compliant to the I2C (Inter Integrated Circuit) standard or the SPI (Serial Peripheral Interface) standard.

The signal line control signal SCT that is provided to the source driver 310 includes a digital video signal representing an image to be displayed, a source start pulse signal, a source clock signal, a latch strobe signal, a polarity control signal, and the like. Based on these signals, the source driver 310 operates a shift register and a sampling latch circuit provided on its inside and not shown, and converts a plurality of digital signals obtained from the digital video signal to analog signals in a DA conversion circuit, not shown, to generate data signals S1 to Sm as driving image signals. The generated data signals S1 to Sm are respectively applied to the source lines SL1 to SLm.

The scanning line control signal GCT provided to the gate driver 320 includes a gate lock signal, a gate start pulse signal, and the like. Based on these signals, the gate driver 320 operates a shift register or the like, not shown, on its inside to generate scanning signals G1 to Gn, which sequentially become active, at a predetermined cycle. The generated scanning signals G1 to Gn are respectively applied to the gate lines GL1 to GLn.

The backlight unit 30 is provided on the rear surface side of the liquid crystal panel 10, and irradiates the rear surface of the liquid crystal panel 10 with backlight. The backlight unit 30 typically includes a plurality of LEDs (Light Emitting Diodes). The backlight unit 30 in the present embodiment is controlled by a backlight control signal BCT generated by the display control circuit 200, but it may be controlled by another method. When the liquid crystal panel 10 is of a reflection type, the backlight unit 30 needs not be provided.

As described above, the data signals are applied to the source line SL, the scanning signals are applied to the gate line GL, and the common electrode signal Scom is applied to the common electrode 113, to drive the backlight unit 30, whereby an image in accordance with the data DAT from the host 80 is displayed on the display unit 100 of the liquid crystal panel 10.

<1.2 AC Driving>

In a typical liquid crystal display device, AC driving is performed where the polarity of an applied voltage to (a liquid crystal layer in) each pixel formation portion is reversed at predetermined intervals so as to prevent deterioration in liquid crystal. In this AC driving, for the purpose of preventing deterioration in display quality, there is often employed a driving system in which voltages with different polarities are applied to pixel formation portions adjacent to each other in a horizontal direction or a vertical direction out of the plurality of pixel formation portions arranged in a matrix form (hereinafter referred to as a "pixel matrix") on the liquid crystal panel. Of the AC driving systems, a system of driving the liquid crystal panel such that the polarity of the applied voltage to the pixel formation portion does not change within the same frame period and the polarity of the applied voltage is reversed at intervals of one or predetermined number of frame periods is called a "frame-reversal driving system"; a system of driving the liquid crystal panel such that the polarity of the applied voltage is reversed on each one or predetermined number of pixel rows is called a "line-reversal driving system"; a system of driving the liquid crystal panel such that the polarity of the applied voltage is reversed on each one or predetermined number of pixel columns is called a "source-reversal driving system" or a "column-reversal driving system"; and a system of driving the liquid crystal panel such that the polarity of the applied voltage is reversed on each one or predetermined number of pixel rows and on each one or predetermined number of pixel columns is called a "dot-reversal driving system". The "pixel row" refers to a row made up of the pixel formation portions arrayed in the horizontal direction (in a direction in which the gate line extends) in the pixel matrix, and the "pixel column" refers to a column made up of the pixel formation portions arrayed in the vertical direction (in a direction in which the source line extends) in the pixel matrix.

Also in the present embodiment, the AC driving is performed where the polarity of the applied voltage to each pixel formation portion 110 is reversed at predetermined intervals (at intervals of a predetermined number of frame periods, the number being one or larger), but any of the frame-reversal driving system, the line-reversal driving system, the source-reversal driving system, and the dot-reversal driving system may be employed. In the present embodiment, a polarity control signal in accordance with the employed driving system is generated in the display control circuit 200, and based on the generated polarity control signal, the data signals S1 to Sm are generated such that the AC driving in accordance with the employed driving system is performed.

<1.3 Pause Driving>

The liquid crystal display device 2 according to the present embodiment has a normal driving mode and a low-frequency driving mode as the driving modes of the display unit 100. In this liquid crystal display device 2, in the normal driving mode, sequential scanning of the gate lines GL1 to GLn is repeated with one frame period (one vertical scanning period) taken as a cycle, and the source lines SL1 to SLm are driven in accordance with the scanning, to thereby refresh an image displayed on the display unit 100 (hereinafter simply referred to as a "display image") in each one frame period.

In contrast to this, in the low-frequency driving mode, the display control circuit 200 controls the pixel electrode drive circuit 300 (the gate driver 320 and the source driver 310) so as to alternately repeat a refresh period (hereinafter also referred to as an "RF period") during which the display image is refreshed, and a non-refresh period (hereinafter also referred to as an "NRF period") during which all the gate lines GL1 to GLn are kept in a non-selected state.

Figure 2:
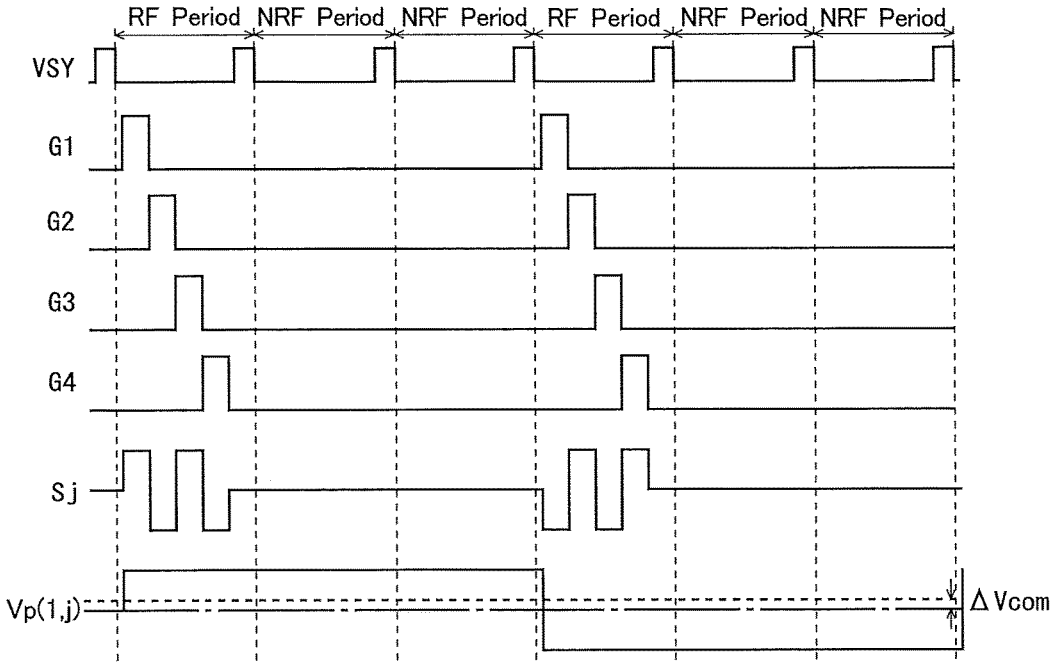
FIG. 2 is a signal waveform diagram for describing operation in a low-frequency driving mode of the first embodiment.

FIG. 2 is a signal waveform diagram for describing operation in a low-frequency driving mode of the liquid crystal display device 2 according to the present embodiment. For convenience of the description, FIG. 2 is depicted with the number of gate lines as scanning signal lines being n=4. In the present embodiment, when an image is displayed on the display unit 100, a pixel voltage, which is held as pixel data in the pixel capacitance Cp of each pixel formation portion 110, is rewritten at a predetermined cycle (see FIG. 1). That is, the image displayed on the display unit 100 (the display image) is refreshed at a predetermined cycle. In the present embodiment, this refresh cycle has three frame periods, where one frame period as the refresh period is followed by two frame periods as the non-refresh periods. As shown in FIG. 2, in the refresh period (RF period), while the scanning signals G1 to G4 to be applied to the gate lines GL1 to GL4 sequentially become active (become a high level), the polarity of a data signal Sj to be applied to each source line SLj is reversed at intervals of one horizontal period (j=1, 2, . . . , m), and during the non-refresh period (the NRF period), all the scanning signals G1 to G4 are non-active. In FIG. 2, a waveform of a pixel voltage Vp (1, j) in the pixel formation portion 110 on the first row and the j-th column, which is connected to the gate line GL1 and the source line SLj, is also depicted along with the counter voltage. Since the refresh cycle has three frame periods as described above, the polarity of the pixel voltage Vp (1, j) with the counter voltage taken as a reference is reversed at intervals of three frame periods as shown in FIG. 2 (this also applies to the polarity of the pixel electrode in each of the other pixel formation portions). A dashed-dotted line indicates a counter voltage as the common electrode signal Scom in a positive-negative balanced state, and a dotted line indicates a counter voltage at the time when the counter voltage in the positive-negative balanced state has changed by ΔVcom. As seen from FIG. 2, this change in counter voltage brings about a difference in effective applied voltage to the liquid crystal layer of each pixel formation portion 110 between the positive and negative polarities.

As described above, "one frame period" is a period for refresh for one screen (rewriting of a display image), and the length of the "one frame period" in the present embodiment is the length (16.67 ms) of one frame period in the typical display device with a refresh rate of 60 Hz. In FIG. 2, each frame period is defined by a vertical synchronous signal VSY that becomes a high level at intervals of one frame period. Note that the refresh cycle in the present embodiment only needs to have two or more frame periods, and a specific number of frame periods is determined in view of the frequency of changes in image to be displayed on the display unit 100 (this also applies to the other embodiments described later). For example, the refresh cycle can be set to have 60 frame periods made up of one frame period as the refresh period and 59 frame periods as the subsequent non-refresh periods, and in this case, the refresh rate is 1 Hz. Further, the length of the refresh period may be two or more frame periods (this also applies to the other embodiments described later).

<1.4 Check and Adjustment Mode>

The liquid crystal display device 2 according to the present embodiment has as operation modes: a normal mode for displaying an image on the display unit 100 based on the data DAT from the host 80 in the above normal driving mode or the low-frequency driving mode; and a check and adjustment mode for measuring flicker sensitivity of the user 4 as the observer of this liquid crystal display device 2 and adjusting either or both of the brightness and refresh cycle of the display image, based on a result of the measurement.

Figure 3:
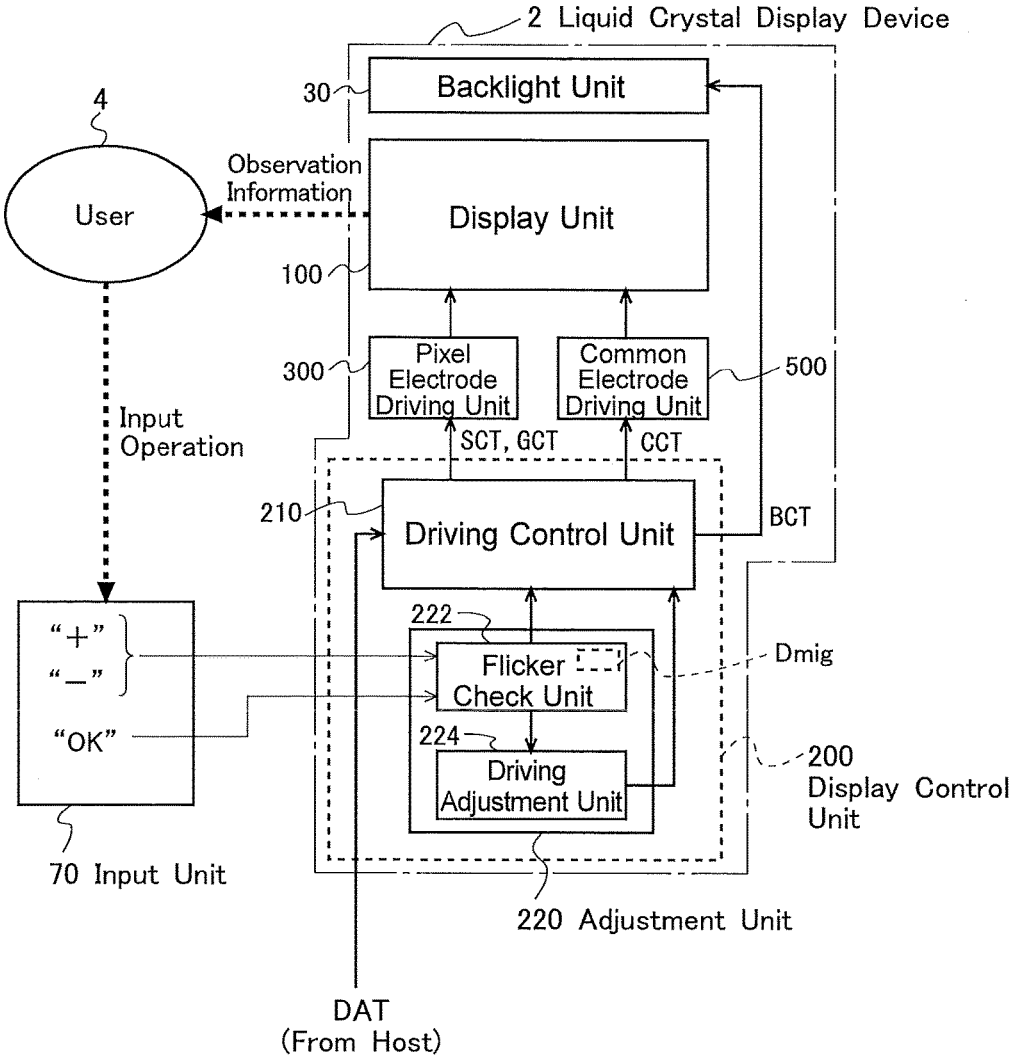
FIG. 3 is a functional block diagram for describing operation in a check and adjustment mode of the first embodiment.

FIG. 3 is a functional block diagram for describing operation in the check and adjustment mode of the liquid crystal display device 2 according to the present embodiment. Of the components shown in FIG. 3, the components corresponding to those in the first embodiment shown in FIG. 1 are denoted by the same reference numerals. As shown in FIG. 3, this liquid crystal display device 2 includes: the display unit 100 for displaying an image based on the data DAT from the host 80; the backlight unit 30 for irradiating the rear surface of the display unit 100 with light; the pixel electrode drive circuit 300 for providing a voltage to each pixel electrode 112 in the display unit 100, the common electrode driving unit 500 for providing a voltage to the common electrode 113 in the display unit 100; and the display control unit 200. The display control unit 200 includes a driving control unit 210 and an adjustment unit 220. The driving control unit 210 controls the pixel electrode drive circuit 300, the common electrode driving unit 500, and the backlight unit 30 based on either or both of the data DAT from the host 80 and the control signal from the adjustment unit 220. The adjustment unit 220 includes a flicker check unit 222 for measuring the flicker sensitivity of the user 4, and a driving adjustment unit 224 for adjusting the driving of the display unit 100 based on the flicker sensitivity obtained by the flicker check unit 222. In the check and adjustment mode, the flicker check unit 222 and the driving adjustment unit 224 are each inputted with an operation signal indicating an input operation by the user 4 from an input unit 70 in the host 80.

Figure 4:
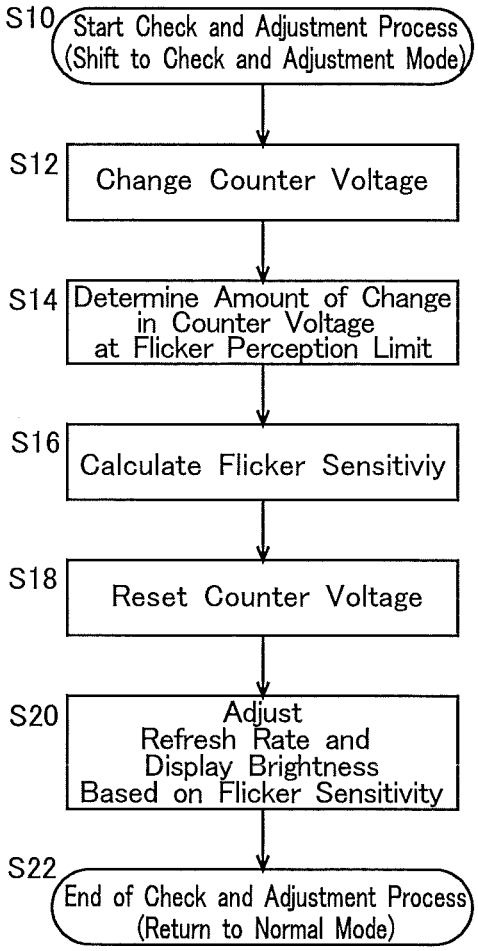
FIG. 4 is a flowchart for describing operation in the check and adjustment mode of the first embodiment.

FIG. 4 is a flowchart for describing operation in the check and adjustment mode of the present embodiment. Hereinafter, the operation in the check and adjustment mode of the present embodiment is described with reference to FIGS. 3 and 4. It is assumed below that, when the display unit 100 is being driven in the low-frequency driving mode, the operation mode shifts from the normal mode to the check and adjustment mode to conduct a check and adjustment process, but in the present invention, the state at the time of the shift to the check and adjustment mode is not limited thereto. Further, it is assumed that in the present embodiment, the image based on the data DAT from the host 80 is displayed on the display unit 100 also in the check and adjustment mode. While there can be considered a configuration where checking image data Dmig is stored in, for example, the flicker check unit 222 in order to display a specific checking image in the check and adjustment mode, this configuration is described later as a second embodiment.

In the present embodiment, when the input unit 70 of the host 80 accepts a predetermined operation by the user 4 in the normal mode, the operation mode of the liquid crystal display device 2 shifts to the check and adjustment mode, and the check and adjustment process is started (Step S10 of FIG. 4).

When the liquid crystal display device 2 is in operation in the normal mode before the start of the check and adjustment process, the polarity of the applied voltage to the liquid crystal in the display unit 100, namely a voltage that is applied to the pixel electrode 112 with the common electrode 113 taken as a reference (hereinafter referred to as a "pixel applied voltage) is reversed at predetermined intervals (at intervals of one frame period in the present embodiment), and the voltage of the common electrode 113 in the display unit 100, namely the counter voltage Vcom, is adjusted so as to come into a state where an effective applied voltage to a positive pixel and an effective applied voltage to a negative pixel are balanced (a state where effective applied voltages to liquid crystal with both polarities are equal, and hereinafter referred to as a "positive-negative balanced state").

When the check and adjustment process is started, the counter voltage is changed from the above positive-negative balanced state (Step S12). Specifically, as the input operation performed by the user 4 on the input unit 70 of the host 80, an operation to increase the counter voltage Vcom (pressing of a "+" button in the present embodiment) and an operation to decrease the counter voltage Vcom (pressing of a "−" button in the present embodiment) are prepared. When the user 4 presses the "+" or "−" button, an operation signal indicating the pressing of the button is inputted into the flicker check unit 222 in the display control unit 200, and the flicker check unit 222 causes the driving control unit 210 to control the common electrode driving unit 500 in accordance with the inputted operation signal, thereby changing the voltage of the common electrode signal Scom, namely the counter voltage Vcom. For example, it is configured such that the counter voltage Vcom is increased by a predetermined amount of unit change ΔV (>0) every time the "+" button is pressed. Alternatively, along with or instead of this, it may be configured such that the counter voltage Vcom increases at a predetermined speed while the "+" button continues to be pressed. Hereinafter, an amount of change in the counter voltage, which takes the counter voltage in the positive-negative balanced state as a reference, is referred to as an "amount of change in counter voltage" and denoted by symbol "ΔVcom".

When the difference in effective voltage between the positive and negative polarities changes by the input operation as described above in an increasing direction from 0 (the positive-negative balanced state) and then exceeds a certain value, the user 4 perceives flicker in the display image. At the point of perception of flicker in the display image, the user 4 performs an operation for confirming a flicker perception limit (pressing of an "OK" button in the present embodiment) on the input unit 70. Accordingly, an operation signal indicating the pressing of the "OK" button (hereinafter referred to as a "perception limit confirming signal") is inputted into the flicker check unit 222 in the display control unit 200, and when inputted with the perception limit confirming signal, the flicker check unit 222 stores the amount of change ΔVcom (>0) in counter voltage at this time as an amount of voltage change ΔVcLim of perception threshold (Step S14). Thereafter, the flicker check unit 222 calculates flicker sensitivity based on the amount of voltage change ΔVcLim of perception threshold (Step S16). A formula for this calculation only needs to be set such that the larger the amount of voltage change ΔVcLim of perception threshold, the smaller the flicker sensitivity. For example, when the counter voltage in the positive-negative balanced state is Vcom0, "1−ΔVcLim/Vcom0" can be defined as the flicker sensitivity.

The calculated flicker sensitivity is provided to the driving adjustment unit 224. Upon receipt of this flicker sensitivity, the driving adjustment unit 224 resets the counter voltage Vcom to the counter voltage Vcom0 in the positive-negative balanced state (Step S18), and then adjusts the refresh rate and the display brightness, based on this flicker sensitivity. That is, the driving adjustment unit 224 determines adjustment amounts of the refresh rate and the display brightness based on this flicker sensitivity and provides them to the driving control unit 210, and the driving control unit 210 stores these adjustment amounts (Step S20). For appropriately determining these adjustment amounts, it is only necessary that, for example, an appropriate relation between the flicker sensitivity and each of the refresh rate and the display brightness is previously obtained by experiment or computer simulation and stored as a table into the driving adjustment unit 224, and the driving adjustment unit 224 refers to the table to determine an appropriate adjustment amount of each of the refresh rate and the display brightness corresponding to the flicker sensitivity. Note that the appropriate relation is, for example, a relation in which as large a refresh cycle or display brightness as possible is provided in a range where the user 4 does not perceive flicker in the display image.

When the adjustment amounts determined as described above are stored into the driving control unit 210, the check and adjustment process is completed (Step S22), and the liquid crystal display device 2 operates with the operation mode returned to the normal mode and with the driving mode remaining in the low-frequency driving mode (FIG. 2). The driving control unit 210 afterward controls the pixel electrode drive circuit 300 and the common electrode driving unit 500 so as to display an image on the display unit 100 with a refresh rate and display brightness in accordance with the adjustment amounts determined and stored as described above. Further, since the brightness of each pixel in the display image is determined based on the data DAT from the host 80, the adjustment of the display brightness can be achieved by correction of data (correction of a data signal) of each pixel which is determined based on the data DAT.

In the present embodiment, as described above, the flicker sensitivity is calculated based on the input operation performed by pressing each of the "+", "−", and "OK" buttons in the input unit 70 (Steps S12, S14 of FIG. 4), and instead of this, it may be configured such that an operation screen is displayed on the display unit 100 by a specific display control program stored in the host 80. In this case, for example, double-clicking of a predetermined icon on the operation screen by a pointing device such as a mouse included in the input unit 70 corresponds to pressing of a predetermined button for starting the check and adjustment process. When the check and adjustment process is started, a "+" icon, a "−" icon, and an "OK" icon are displayed on the operation screen. In this case, clicking of the "+" icon corresponds to pressing of the "+" button, clicking of the "−" icon corresponds to pressing of the "−" button, and clicking of the "OK" icon corresponds to pressing of the "OK"

button. Also in such a configuration, it is possible to perform a substantially similar check and adjustment process to the foregoing check and adjustment process where the user 4 performs the operation on the input unit 70 by pressing the button (see FIG. 4).

In the present embodiment, the flicker check unit 222, the driving adjustment unit 224, and the driving control unit 210 which provide the functions required for the check and adjustment process (FIG. 4) are respectively achieved as dedicated hardware including logic circuits that correspond to those functions, namely as a flicker check circuit, a driving adjustment circuit, and a driving control circuit (this also applied to the other embodiments described later). Further, instead of this, some or all of the functions of the flicker check unit 222, the driving adjustment unit 224, and the driving control unit 210 may be implemented in software by causing a microcomputer which includes a CPU, a memory, and the like to execute a predetermined program.

<1.5 Measurement of Brightness change Ratio and Flicker Ratio, and Action of Present Embodiment>

FIGS. 5(A) and 5(B) are signal waveform diagrams for describing measurement to confirm an action of the present embodiment. In this measurement, the liquid crystal display device was driven at a refresh rate of 5 Hz by use of a scanning signal and a data signal as shown in FIGS. 5(A) and 5(B), and during this low-frequency driving, a brightness change ratio and a flicker ratio were obtained at the time of changing the counter voltage Vcom from its optimum value (a voltage value corresponding to the positive-negative balanced state). FIGS. 6(A) and 6(B) are diagrams showing results of the measurement, namely the brightness change ratios and the flicker ratios obtained at the time of changing the counter voltage Vcom from its optimum value. The brightness change ratio is a change ratio of the display brightness at the time of polarity reversal of the applied voltage to the liquid crystal layer, and the flicker ratio is a ratio of an AC amount with respect to a direct current (DC) amount in the display brightness. Note that in this measurement, LCD flicker checker LT9213A, manufactured by LEADER ELECTRONICS CORP. (address: 2-6-33 Tsunashima-Higashi, Kohoku-ku, Yokohama-shi, Kanagawa, Japan), was used.

As seen from FIGS. 5(A) and 5(B) and FIGS. 6(A) and 6(B), the display brightness changes in accordance with the change ΔVcom in the counter voltage Vcom. When the counter voltage Vcom is changed from its optimum value (the value corresponding to the positive-negative balanced state), the brightness change ratio increases, and the flicker ratio also increases accordingly.

It is seen from the above that in the present embodiment that, when the counter voltage Vcom is changed from its optimum value, the flicker ratio increases and the user 4 perceives flicker in the display image. As has been described, in the present embodiment, in the process of changing the counter voltage Vcom in the above manner, an amount of change ΔVcom (an amount of change ΔVcom from the optimum value) in the counter voltage Vcom at the time when the user 4 starts to perceive flicker is obtained as the amount of voltage change ΔVcLim of perception threshold based on the confirming operation (pressing of the "OK" button) by the user 4, and the flicker sensitivity (the easiness to perceive flicker by the user 4) is determined based on this amount of voltage change ΔVcLim of perception threshold (see FIG. 4).

In the meantime, a reciprocal of a threshold of contrast that can be perceived by the human, namely contrast sensitivity, decreases as the human gets more tired from a normal state. For this reason, in a case where alternate switching on and off of a certain display is repeated at a fixed switch frequency in the display device, when the display brightness or contrast (at the on-time) is increased from a small value around 0, the display brightness or contrast with which the human starts to perceive flicker increases as the human gets more tired from the normal state (see Patent Document (Japanese Patent Application Laid-Open No. 2010-88862), [0086]). That is, the contrast sensitivity decreases as the human gets more tired from the normal state, and as a result, in the present embodiment, the flicker sensitivity calculated based on the amount of voltage change ΔVcLim of perception threshold also decreases as the human gets more tired. Hence the amount of voltage change ΔVcLim of perception threshold can also be regarded as an index indicating the degree of fatigue of the user 4.

Meanwhile, it is known that, when alternate switching on and off of a certain display is repeated in the display device and the on-off switch frequency is gradually decreased from a satisfactorily high value, the switch frequency, namely a flicker value, with which the human starts to perceive flicker decreases as the human gets more tired from the normal state (see Patent Document 4 (Japanese Patent Application Laid-Open No. 2010-88862), [0002]). Hence in the present embodiment, the degree of fatigue of the user 4 is considered based on the amount of voltage change ΔVcLim of perception threshold, and from the viewpoint of reduction in power consumption of the liquid crystal display device, the refresh rate is preferably made low (the refresh cycle is made long) in the range where the user 4 does not perceive flicker.

Figure 7:
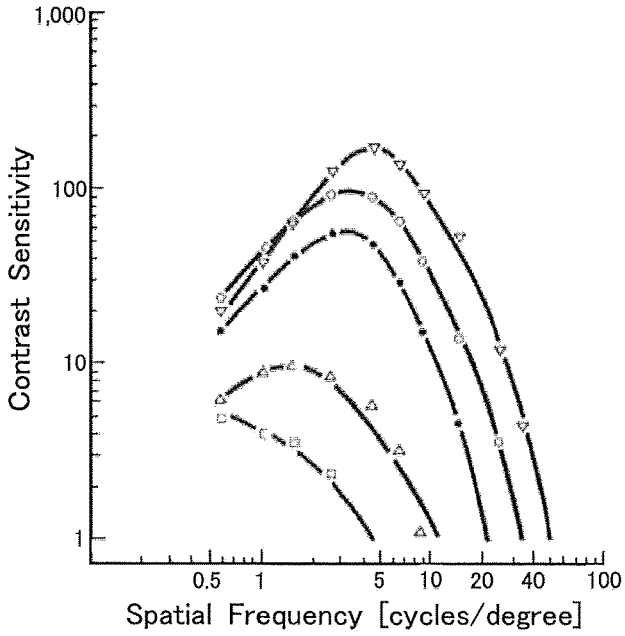
FIG. 7 is a diagram for describing the action of the first embodiment.

Further, as data indicating a spatial frequency characteristic of the contrast sensitivity for each kind of average brightness, for example, measurement data shown in FIG. 7 is known. FIG. 7 is a diagram corresponding to FIG. 4 described in Non-patent Document 1, which shows a spatial frequency characteristic of contrast sensitivity for each of five kinds of average brightness: 0.0005, 0.005, 0.05, 0.5, and 5 (the unit of the average brightness is [ft−L] (lumen per square foot)). It is seen from FIG. 7 that in almost every spatial frequency, the higher the average brightness, the higher the contrast sensitivity. Considering this, from the viewpoint of reducing the fatigue by improvement in display quality and improvement in visibility, in the present embodiment, when the user 4 is tired and the contrast sensitivity has decreased, it is preferable to increase the average brightness in the range where the user 4 does not perceive flicker.

As described above, the present embodiment is configured so as to increase the refresh cycle and the display brightness in the range where the user 4 does not perceive flicker in the display image, based on the flicker sensitivity calculated from the amount of voltage change ΔVcLim of perception threshold which indicates the degree of fatigue of the user 4 (see the above description concerning FIGS. 3 and 4).

<1.6 Effects>

According to the present embodiment described above, the amount of voltage change ΔVcLim of perception threshold is obtained by changing the counter voltage Vcom from its optimum value (the value corresponding to the positive-negative balanced state) until the user 4 perceives flicker, and the refresh rate and the display brightness are adjusted based on the flicker sensitivity corresponding to this amount of voltage change ΔVcLim of perception threshold (in consideration of the degree of fatigue of the user 4) (see FIG. 4). Accordingly, in the range where the user 4 does not perceive flicker in the display image, the image can be displayed at a low refresh rate (in along refresh cycle) and with high display brightness. As a result, power consumption can be reduced more than before by the decrease in driving frequency, a favorable display image can be provided to the user 4 by the improvement in display brightness, and the fatigue of the observer can be reduced by the improvement in visibility.

According to the present embodiment, during the pause driving for the image display based on the data DAT from the host 80, as described above, it is possible to obtain the flicker sensitivity (the amount of voltage change ΔVcLim of perception threshold) and perform the process of adjusting the refresh rate and the like (the check and adjustment process shown in FIG. 4). This enables the above check and adjustment process to be performed in a state close to the normal use environment, and eliminates the need to provide a special display pattern for the check and adjustment process, whereby it is possible to suppress increases in burden of the user 4 and cost for the flicker check.

<2. Second Embodiment>

Next, a liquid crystal display device according to a second embodiment of the present invention is described. Similarly to the above first embodiment, the present embodiment has a check and adjustment mode for performing the check and adjustment process shown in FIG. 4, but is different from the above first embodiment in that an image displayed in this check and adjustment mode is not an image based on the data DAT from the host 80, but a previously prepared specific checking image. The present embodiment has a similar configuration to that of the above first embodiment except the configuration for displaying the checking image in the check and adjustment mode. Of the configurations of the present embodiment, therefore, portions which are the same as or correspond to those in the above first embodiment are denoted by the same reference numerals, and detailed descriptions thereof are omitted.

Figure 8:
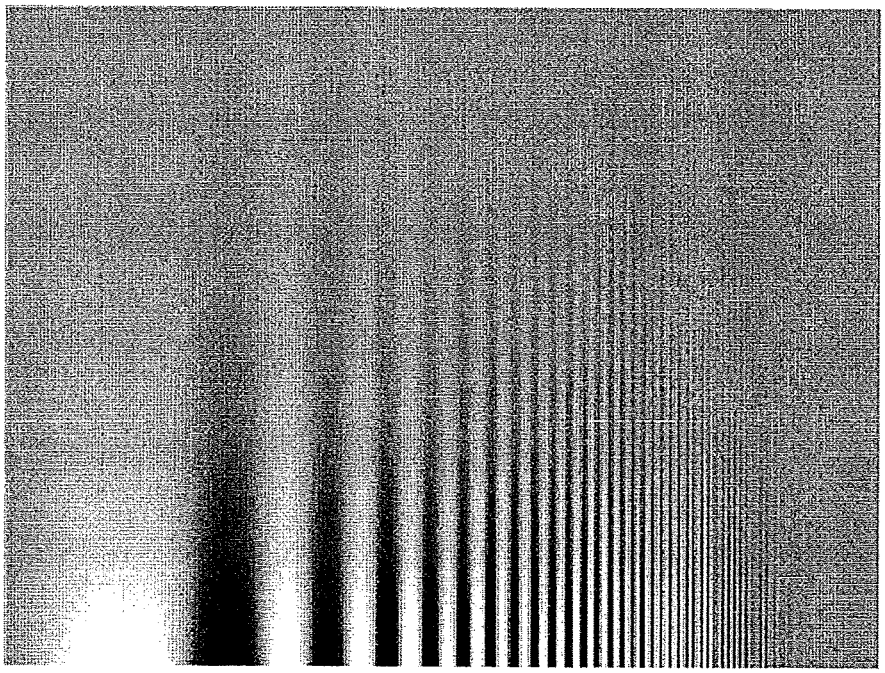
FIG. 8 is a view showing an example of a checking image used in a liquid crystal display device according to a second embodiment of the present invention.

In the present embodiment, data representing the checking image (hereinafter referred to as "checking image data") Dmig is previously stored into the flicker check unit 222 in the display control unit 200 (see FIG. 3). This checking image is an image where, when the image is displayed on the display unit 100, the brightness changes so as to increase the spatial frequency in a first direction which is one of the horizontal and vertical directions on the screen of the display unit 100, and the brightness changes so as to decrease the contrast in a second direction which is the other of the horizontal and vertical directions. For example, a Campbell-Robson CSF Chart, or Campbell-Robson Chart, as shown in FIG. 8 can be used as the checking image in the present embodiment. The Campbell-Robson Chart is typically used for obtaining the spatial frequency characteristic of the contrast sensitivity of the human's visual system, and a detection threshold as a curve connecting positions of recognizable limits of contrast (stripes) for the human indicates the spatial frequency characteristic of the contrast sensitivity.

In the present embodiment, when the input unit 70 of the host 80 accepts a predetermined operation by the user 4 in the normal mode, the operation mode of the liquid crystal display device 2 shifts to the check and adjustment mode, and the checking image data Dmig stored in the flicker check unit 222 is transmitted to the driving control unit 210 (see Step S10 of FIG. 4). Upon receipt of this checking image data, the driving control unit 210 controls the pixel electrode drive circuit 300 and the common electrode driving unit 500 such that a checking image represented by this checking image data Dmig is displayed on the display unit 100 instead of the image represented by the data DAT from the host 80. The check and adjustment process (FIG. 4) in the present embodiment is performed in a state where this checking display image is displayed.

When the image represented by the data DAT from the host 80 is displayed in the check and adjustment mode as in the above first embodiment, since the spatial frequency and the contrast of the displayed image are not restricted, it may not be possible, depending on the data DAT, that the user 4 perceives flicker even if the counter voltage Vcom is changed, and thus not possible to measure the flicker sensitivity by the process of Steps S12 to S16 shown in FIG. 4. This necessitates waiting for the image represented by the data DAT from the host 80 to become suitable for the measurement of the flicker sensitivity, and hence the check and adjustment process may take time.

In contrast to this, in the present embodiment, since the checking image such as Campbell-Robson Chart, which includes a wide range of spatial frequency and a wide range of contrast, is displayed in the check and adjustment mode, the user 4 reliably perceives flicker by the process of Steps S12 to S14 of FIG. 4. As a result, the flicker sensitivity can be reliably calculated based on the amount of voltage change ΔVcLim of perception threshold which corresponds to the flicker perception. Therefore, according to the present embodiment, the flicker sensitivity can be measured, and based thereon, the refresh rate and the like can be adjusted reliably and in a short time.

<3. Third Embodiment>

Next, a liquid crystal display device according to a third embodiment of the present invention will be described. As has been described, in the above first embodiment, the counter voltage Vcom being the fixed voltage is provided to the common electrode 113 as the common electrode signal Scom (see FIGS. 1 and 2). In contrast to this, the line-reversal driving system is employed in the present embodiment, and the common electrode signal Scom is a signal that changes the voltage level between a predetermined high level and a predetermined low level in conjunction with polarity reversal of the data signal Sj (such driving of the common electrode by the common electrode signal Scom is referred to as "counter AC driving"). In the present embodiment, the driving control unit 210, the common electrode driving unit 500, and the like are configured so as to perform the AC driving of the line-reversal driving system and perform the counter AC driving on the common electrode (see FIG. 3), but the other configurations are similar to those of the above first embodiment. Of the configurations of the present embodiment, therefore, portions which are the same as or correspond to those in the above first embodiment are denoted by the same reference numerals, and detailed descriptions thereof are omitted.

Figures 9A, 9B, 9C, 9D, 9E:
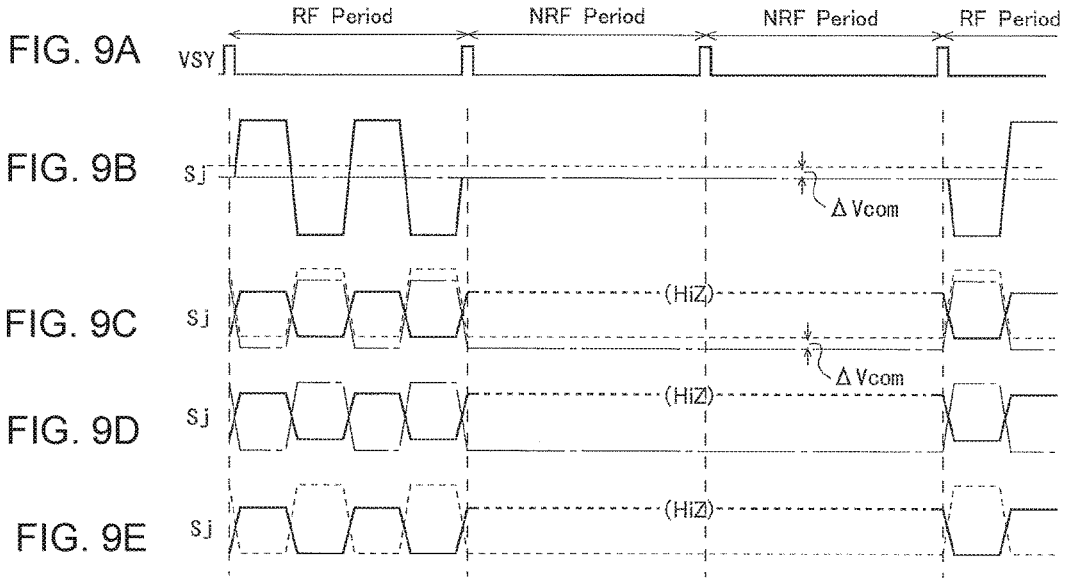
FIGS. 9(A) to 9(E) are signal waveform diagrams for describing operation of a liquid crystal display device according to a third embodiment of the present invention.

FIGS. 9(A) to 9(E) are signal waveform diagrams for describing operation of the liquid crystal display device according to the present embodiment. As shown in FIG. 9(A), in the present embodiment, each frame period is defined by the vertical synchronous signal VSY that becomes a high level at intervals of one frame period, and in the low-frequency driving mode, the pause driving (the low-frequency driving) is performed where the refresh period (the RF period) being one frame period and the non-refresh period (the NRF period) made up of two frame periods alternately appear. FIG. 9(B) shows, for the sake of comparison, a waveform of the data signal Sj along with a waveform of the common electrode signal Scom in a case where the line-reversal driving system is employed in the above first embodiment. Each of FIGS. 9(C) to 9(E) shows both a waveform of the data signal Sj and a waveform of the common electrode signal Scom in the present embodiment. Note that in each of FIGS. 9(B) to 9(E), a dashed-dotted thin line indicates the waveform of the common electrode signal Scom in the positive-negative balanced state, and a dotted thin line indicates the waveform of the common electrode signal Scom at the time when the counter voltage Vcom changes from the voltage value in the positive-negative balanced state (the optimum value) by ΔVcom.

As seen by comparison between FIG. 9(B) and FIG. 9(C), etc., in the present embodiment, by changing the voltage Vcom of the common electrode signal Scom in conjunction with the polarity reversal of the data signals S1 to Sm, namely by the counter AC driving, amplitudes of the data signals S1 to Sm can be significantly reduced as compared with the case of providing the fixed voltage Vcom as the common electrode signal Scom as in the first embodiment (the driving of the common electrode is referred to as "counter DC driving"). This enables reduction in power consumption of the source driver 310 as the data signal line drive circuit. Further, performing the counter AC driving as in the present embodiment leads to a decrease in difference between the positive voltage and the negative voltage in the data signals S1 to Sm. Hence it is possible to prevent a decrease in contrast of the display image caused by voltage drop of the data signals S1 to Sm due to resistance and capacitance which are parasitic in the source driver 310 and the like.

As described above, according to the present embodiment, in addition to the reduction in power consumption by adjustment of the refresh rate as in the above first embodiment, it is possible to further reduce the power consumption by the above counter AC driving. Moreover, in addition to the achievement of favorable display by adjustment of the display brightness as in the above first embodiment, it is possible to obtain an effect of being able to prevent a decrease in contrast and keep favorable display by the above counter AC driving.

<4. Modified Example>

The present invention is not limited to each of the above embodiments, and can be subjected to a variety of modifications so long as not deviating from the scope of the present invention.

For example, in each of the above embodiments, the check and adjustment process (FIG. 4) is conducted in the low-frequency driving mode, but the check and adjustment process may be conducted in the normal driving mode, or it may be configured such that the check and adjustment process can be conducted in any one of the low-frequency driving mode and the normal driving mode.

Further, in each of the above embodiments, both the refresh rate and the display brightness are adjusted based on the flicker sensitivity calculated in the check and adjustment process of FIG. 4, but it may be configured such that either the refresh rate or the display brightness is adjusted. When the display brightness is to be adjusted based on the flicker sensitivity, in the above first embodiment, the adjustment of the display brightness is achieved by correction of pixel data of an image to be displayed, and thus by correction of the data signals S1 to Sm. However, instead of this, it may be configured such that the display brightness is adjusted by correction of the backlight control signal BCT by the driving control unit 210 in the display control unit 200 based on the flicker sensitivity. Further, in each of the above embodiments, the refresh rate and the display brightness are adjusted based on the flicker sensitivity calculated from the amount of voltage change ΔVcLim of perception threshold, but the flicker sensitivity may not be calculated, and the amount of voltage change ΔVcLim of perception threshold may be used as the index indicating the easiness to perceive flicker, thereby adjusting either or both of the refresh rate and the display brightness based on the amount of voltage change ΔVcLim of perception threshold.

Moreover, the display device according to each of the embodiments is the liquid crystal display device and the AC driving system is employed. In the above third embodiment, the line-reversal driving system is employed as the AC driving system since the counter AC driving is performed. Instead of this, the frame-reversal driving system may be employed. The present invention is not limited to the liquid crystal display device, but is also applicable to a display device of the AC driving system other than the liquid crystal display device.

INDUSTRIAL APPLICABILITY

The present invention is applicable to a display device of an AC driving system, such as a liquid crystal display device, and a method for driving the same, and is particularly suitable for a liquid crystal display device that performs pause driving (low-frequency driving).

DESCRIPTION OF REFERENCE CHARACTERS

2: LIQUID CRYSTAL DISPLAY DEVICE
4: USER
30: BACKLIGHT UNIT
70: INPUT UNIT
80: HOST
100: DISPLAY UNIT
111: THIN FILM TRANSISTOR (TFT) (SWITCHING ELEMENT)
112: PIXEL ELECTRODE
113: COMMON ELECTRODE
200: DISPLAY CONTROL CIRCUIT (DISPLAY CONTROL UNIT)
210: DRIVING CONTROL UNIT
220: ADJUSTMENT UNIT
222: FLICKER CHECK UNIT
224: DRIVING ADJUSTMENT UNIT
300: PIXEL ELECTRODE DRIVE CIRCUIT (PIXEL ELECTRODE DRIVING UNIT)
310: SOURCE DRIVER (DATA SIGNAL LINE DRIVE CIRCUIT)
320: GATE DRIVER (SCANNING SIGNAL LINE DRIVE CIRCUIT)
500: COMMON ELECTRODE DRIVE CIRCUIT (COMMON ELECTRODE DRIVING UNIT)
SL1 to SLm: SOURCE LINE (DATA SIGNAL LINE)
GL1 to GLn: GATE LINE (SCANNING SIGNAL LINE)
Scom: COMMON ELECTRODE SIGNAL
Vcom: COUNTER VOLTAGE

The invention claimed is:

1. A method for driving a display device which displays an image by reversing polarity of a voltage at predetermined intervals and applying the voltage between each of a plurality of pixel electrodes and a common electrode that is provided so as to face the plurality of pixel electrodes in a display, the method comprising:

a pixel electrode driving step of providing a voltage to each of the plurality of pixel electrodes;

a common electrode driving step of providing a voltage to the common electrode; and a display controlling step of controlling supply of a voltage to each of the plurality of pixel electrodes by the pixel electrode driving step and supply of a voltage to the common electrode by the common electrode driving step, wherein the display controlling step includes:

a driving controlling step of causing the pixel electrode driving step to provide a plurality of pixel voltages in accordance with an inputted image signal respectively to the plurality of pixel electrodes and causing the common electrode driving step to provide a predetermined counter voltage to the common electrode, so as to display an image indicated by the image signal on the display, a flicker checking step of causing the common electrode driving step to change the counter voltage from a state where positive and negative effective voltages which are applied between each of the pixel electrodes and the common electrode are balanced, and obtaining an index indicating easiness to perceive flicker of a display image on the display, based on an input operation in accordance with perception of flicker by an observer of the display, and a driving adjustment step of bringing the counter voltage back into the state where the positive and negative effective voltages are balanced when the index is obtained by the flicker checking step, and adjusting either or both of a refresh cycle and brightness of the display image in increasing directions in accordance with the obtained index, wherein a low-frequency driving mode is provided as a driving mode of the display, in the driving controlling step, when the driving mode is the low-frequency driving mode, the supply of the voltages to the plurality of pixel electrodes and the supply of the voltage to the common electrode are controlled such that a refresh period for refreshing the display image on the display based on the image signal and a non-refresh period for pausing refresh of the display image alternately appear, and in the flicker checking step, the index is obtained when the driving mode is the low-frequency driving mode.

2. A method for driving a display device which displays an image by reversing polarity of a voltage at predetermined intervals and applying the voltage between each of a plurality of pixel electrodes and a common electrode that is provided so as to face the plurality of pixel electrodes in a display, the method comprising:

a pixel electrode driving step of providing a voltage to each of the plurality of pixel electrodes;

a common electrode driving step of providing a voltage to the common electrode; and a display controlling step of controlling supply of a voltage to each of the plurality of pixel electrodes by the pixel electrode driving step and supply of a voltage to the common electrode by the common electrode driving step, wherein the display controlling step includes:

a driving controlling step of causing the pixel electrode driving step to provide a plurality of pixel voltages in accordance with an inputted image signal respectively to the plurality of pixel electrodes and causing the common electrode driving step to provide a predetermined counter voltage to the common electrode, so as to display an image indicated by the image signal on the display, a flicker checking step of causing the common electrode driving step to change the counter voltage from a state where positive and negative effective voltages which are applied between each of the pixel electrodes and the common electrode are balanced, and obtaining an index indicating easiness to perceive flicker of a display image on the display, based on an input operation in accordance with perception of flicker by an observer of the display, and a driving adjustment step of bringing the counter voltage back into the state where the positive and negative effective voltages are balanced when the index is obtained by the flicker checking step, and adjusting either or both of a refresh cycle and brightness of the display image in increasing directions in accordance with the obtained index, and in the driving controlling step, when the index is obtained by the flicker checking step, the supply of the voltages to the plurality of pixel electrodes and the supply of the voltage to the common electrode are controlled such that a predetermined checking image is displayed on the display instead of the image indicated by the image signal, the checking image being an image where the brightness changes so as to increase a spatial frequency in a first direction on a screen of the display and the brightness changes so as to decrease contrast in a second direction on the screen.

3. A method for driving a display device which displays an image by reversing polarity of a voltage at predetermined intervals and applying the voltage between each of a plurality of pixel electrodes and a common electrode that is provided so as to face the plurality of pixel electrodes in a display, the method comprising:

a pixel electrode driving step of providing a voltage to each of the plurality of pixel electrodes;

a common electrode driving step of providing a voltage to the common electrode; and a display controlling step of controlling supply of a voltage to each of the plurality of pixel electrodes by the pixel electrode driving step and supply of a voltage to the common electrode by the common electrode driving step, wherein the display controlling step includes:

a driving controlling step of causing the pixel electrode driving step to provide a plurality of pixel voltages in accordance with an inputted image signal respectively to the plurality of pixel electrodes and causing the common electrode driving step to provide a predetermined counter voltage to the common electrode, so as to display an image indicated by the image signal on the display, a flicker checking step of causing the common electrode driving step to change the counter voltage from a state where positive and negative effective voltages which are applied between each of the pixel electrodes and the common electrode are balanced, and obtaining an index indicating easiness to perceive flicker of a display image on the display, based on an input operation in accordance with perception of flicker by an observer of the display, and a driving adjustment step of bringing the counter voltage back into the state where the positive and negative effective voltages are balanced when the index is obtained by the flicker checking step, and adjusting either or both of a refresh cycle and brightness of the display image in increasing directions in accordance with the obtained index, and in the driving controlling step, the supply of the voltage to the common electrode is controlled so as to provide the common electrode with a voltage as the counter voltage, a level of the voltage being switched between a predetermined high level and a predetermined low level in conjunction with the polarity reversal at predetermined intervals.

* * * * *